United States Patent [19]

Wolfseder

[11] Patent Number: 4,619,363

[45] Date of Patent: Oct. 28, 1986

[54] MULTIPLE TRAY-SHAPED PACKING AND STORAGE UNIT

[75] Inventor: Alfred Wolfseder, Unterhaching, Fed. Rep. of Germany

[73] Assignee: Gregor Hofbauer GmbH, Planegg, Fed. Rep. of Germany

[21] Appl. No.: 695,876

[22] Filed: Jan. 29, 1985

[30] Foreign Application Priority Data

Feb. 27, 1984 [DE] Fed. Rep. of Germany ..... 3407043

[51] Int. Cl.[4] ..... B65D 85/28

[52] U.S. Cl. ..... 206/373; 206/372; 206/503; 220/4 C; 220/23.6

[58] Field of Search ..... 220/4 C, 4 D, 23.6, 220/23.83; 206/372, 373, 375, 376, 378, 499, 503, 821

[56] References Cited

U.S. PATENT DOCUMENTS

| | | | |
|---|---|---|---|
| 2,326,414 | 8/1943 | Thompson | 220/4 D |
| 2,740,517 | 4/1956 | Evans | 206/373 |
| 3,317,087 | 5/1967 | Landis | 220/23.6 |
| 3,539,071 | 11/1970 | Ludder | 220/23.6 |
| 3,737,031 | 6/1973 | Carroll | 220/23.6 |
| 3,856,178 | 12/1974 | Norgaard | 220/23.83 |
| 3,885,672 | 5/1975 | Westenrider | 206/503 |
| 4,078,701 | 3/1978 | Clubb | 220/4 D |
| 4,089,414 | 5/1978 | Sandor et al. | 220/23.6 |
| 4,144,968 | 3/1979 | Shelton | 220/23.83 |
| 4,212,415 | 7/1980 | Neely | 220/4 D |
| 4,340,140 | 7/1982 | Wilcox et al. | 206/373 |
| 4,380,293 | 4/1983 | Wilcox et al. | 206/378 |
| 4,423,687 | 1/1984 | Serra | 206/503 |
| 4,440,303 | 4/1984 | Seager | 220/4 D |
| 4,460,085 | 7/1984 | Jantzen | 206/373 |
| 4,501,355 | 2/1985 | Hoffman | 206/503 |

*Primary Examiner*—Joseph Man-Fu Moy
*Assistant Examiner*—David T. Fidei
*Attorney, Agent, or Firm*—James E. Nilles

[57] ABSTRACT

Described is a tray-shaped packing container, particularly for containing components of a combination tool system or the like. The packing container may at the same time be used as a storage container, and may be combined with further containers of similar construction to form a packing and storage unit. To this purpose, the sidewalls and bottom of the packing container are formed of a shape-retaining material, the outer surfaces of at least two opposite sidewalls being provided with locking means for engagement with connecting elements employed for interconnecting stacked packing containers of the same type. Adjacent the sidewalls the bottom of the container is formed with a circumferentially extending recess dimensioned to receive the free upper edges of the sidewalls of a subjacent container. The packing container is finally provided with a transparent cover, so that no further packing materials are required. In a preferred embodiment the connecting elements are formed with engagement lugs and disposed in a recess of the respective sidewall, so that they do not project from the outer surface of the sidewalls. Also provided is a cover lid having similar engagement lugs and a similar circumferentially extending recess, so that it can be combined with any of the packing containers.

13 Claims, 5 Drawing Figures

MULTIPLE TRAY-SHAPED PACKING AND STORAGE UNIT

BACKGROUND OF THE INVENTION

The present invention relates to a packing container of the type defined in the generic clause of claim 1.

Conventional packing containers for tools, for instance for a hand power drill and a system of accessories therefor, consist of a folded carboard box having a foamed plastics insert formed with depressions or cavities in the shape of the tools or accessories to be packed. Even if made of a relatively strong cardboard, boxes of this type are not very durable and become worn after a short period of frequent use. The user has then the choice to place the foamed plastics insert in a more rigid container of similar size, which may have to be specifically made to this purpose, or to store the tools without packing containers. While the first of these possibilities is rather expensive and cumbersome, the second possibility involves the danger of the tools getting lost or being damaged.

The purchase of additional accessories, for instance of a fret saw, an oscillating grinder or the like, involves the further problem that all of these accessories are packed in individual containers, usually of different sizes. This results in additional difficulties with regard to storage and carriage of such tools and accessories.

From DE-PS No. 27 627 there is already known a carrying case assembly which may be extended in the downwards direction by adding individual lidless casing components. The casing components are held together by metal fastener elements to be inserted through lots formed in their bottoms, and by a strap slung around the assembled components. The indicidual casing components are unsuitable, however, for use as storage containers, as they cannot be individually separated from the assembly. In addition, the manner in which the casing components placed on top of one another are interconnected is rather cumbersome. Particularly in the case of already filled container components or of containers having an insert shaped to conform to the shape of objects to be stored, the assembly of the components is rather difficult and has to be accomplished by the trial and error method. Moreover, smaller objects may drop out through the slots and thus get lost.

SUMMARY OF THE INVENTION

It is an object of the present invention to provide a sturdy packing container, particularly for tools and the like, which may also be used as a storage container and can be combined with additional similar containers to form a packing and storage unit.

This object is attained by the provisions set forth in the characterizing clause of the main claim.

The material employed for the packing container according to the invention and the design thereof permit the container in its original state to be displayed for sale. The shape-retaining properties of the container further permit it to be used as a storage container for an extended period. The locking means disposed on the sidewalls and the recess extending around the bottom finally permit a plurality of containers according to the invention to be stacked and connected to one another to form a unitary structure. In this case any of the containers, including a container from the middle of the stacked unit, may readily be removed from the assembled structure.

The design of the locking means and the connecting elements makes for easy manipulation.

The design of the engagement elements offers a solution which makes for easy manipulation and particularly simple manufacture.

The engagement of the connecting elements is further improved by alternative constructions.

The connecting elements do not project to any substantial degree beyond the outer surfaces of the sidewalls, so that accidental release of the connecting elements is substantially avoided.

The design set forth offers a particularly advantageous solution with regard to manufacturing techniques.

The employ of the additional cover lid specified in claim 8 permits the packing container according to the invention to be readily carried.

The connecting elements used for connecting the cover to the topmost packing container may be identical to those, and employed in the same manner, as the connecting elements used to connect adjacent packing containers to each other.

The design permits the cover to be likewise employed for accommodating tools or accessories therein.

The construction of the connecting elements offers a particularly simple solution with respect to its manufacture, and results in a particularly flat configuration.

The inventor permits each packing container to be simply grasped from above and to be readily-carried about.

The invention furthermore facilitates handling of the packing container.

The construction makes for particularly simple manufacture of the packing container.

Claim 17 describes a further preferred embodiment further facilitating handling and manufacture of the packing container.

The invention, in a more limited aspect, permits the packing container according to the invention to be suspended from a wall or the like for use.

BRIEF DESCRIPTION OF THE DRAWINGS

Embodiments of the invention shall now be described by way of example with reference to the accompanying drawings, wherein.

DESCRIPTION OF THE PREFERRED EMBODIMENTS

Figure 1:
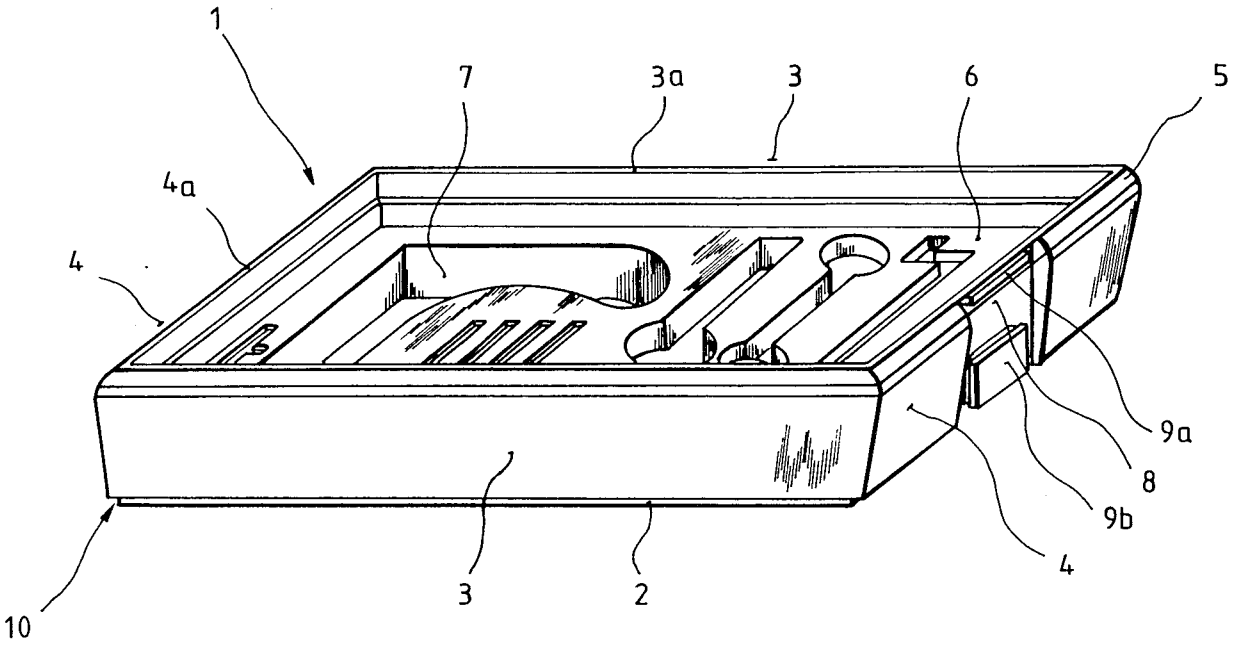
FIG. 1 shows a perspective view of a packing container according to one embodiment of the invention.

FIG. 1 shows a tray-shaped packing container 1 having a bottom 2, pairs of opposite long and short sidewalls 3, 4, and a transparent cover 5. Visible through cover 5 is an insert 6 disposed in container 1 and formed with cavities 7 of shapes corresponding to those of tools or the like to be packed. Bottom 2, sidewalls 3 and 4, and insert 6 are integrally injection moulded of a plastics material. Transparent cover 5 also consists of a plastics material and may be replaced by a transparent sheet welded about packing container 1. A pair of opposite sidewalls, preferably the shorter sidewalls 4, are formed with a respective central recess 8 having a suitable width with respect to the length of sidewall 4 and extending over the full height of the sidewall. Disposed within each recess 8 are locking means 9 formed integrally with the respective sidewall 4. Locking means 9 are in the form of two substantially rectangular projections 9*a* and 9*b* disposed above one another and having horizontal bordering edges extending parallel to bottom 2.

Bottom 2 is formed with a circumferentially extending recess 10 the width of which corresponds to that of the free upper edges 3*a* and 4*a*, respectively, of sidewalls 3 and 4. Recess 10 is located at a position vertically below free upper edges 3*a* and 4*a*. Recess 10 is preferably formed along the peripheral edge of bottom 2 adjoining sidewalls 3 and 4.

Figure 2:
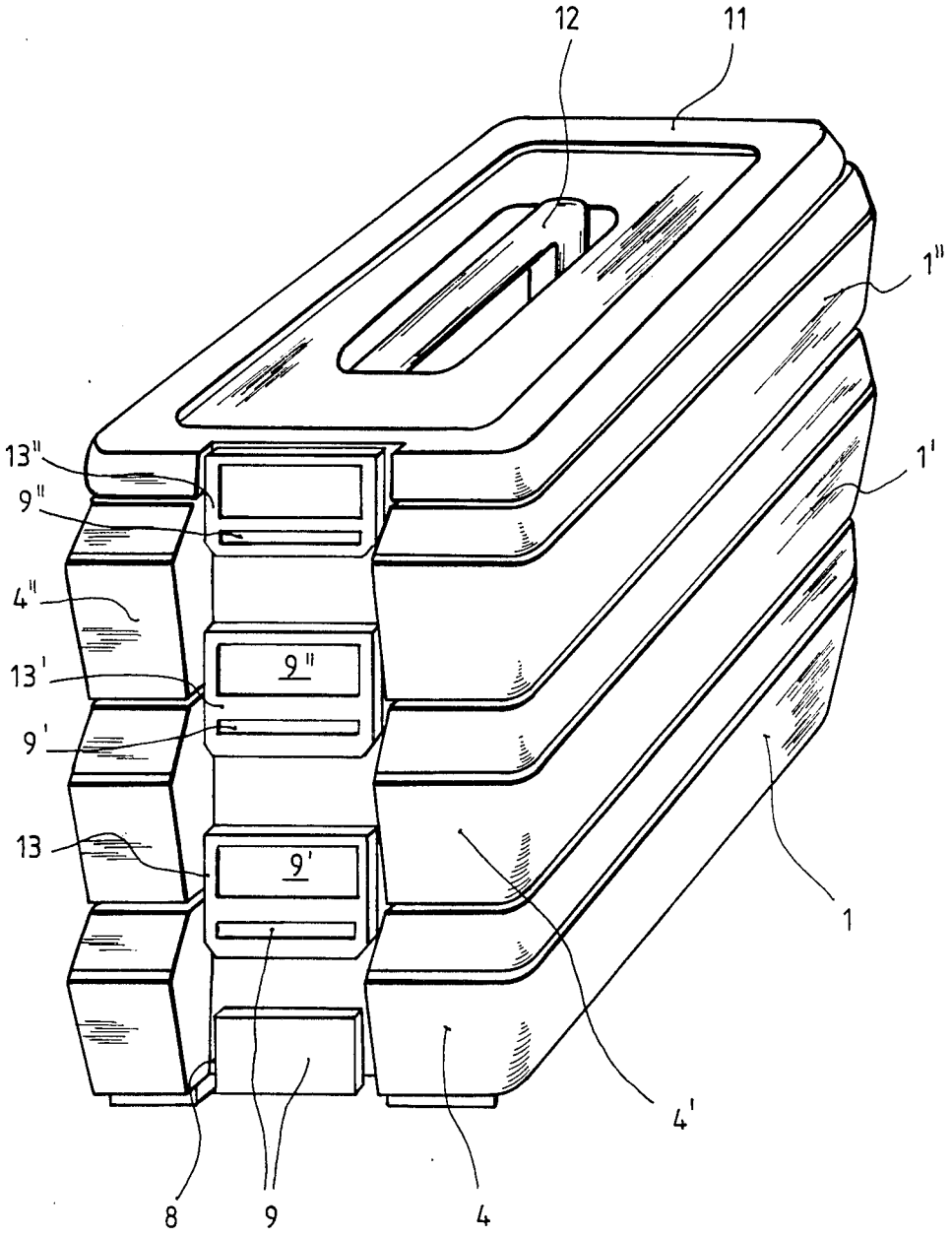
FIG. 2 shows a perspective view of a packing and storage unit including a cover lid.

A packing and storage unit shown in FIG. 2 comprises three stacked packing containers 1, 1' and 1'' with transparent covers removed and upper edges 3*a* and 4*a* of each lower container engaging recess 10 of the container thereabove. Placed on top of uppermost container 1'' is a cover lid 11 having a carrying handle 12 which may be integrally formed with lid 11 or secured thereto in any suitable manner.

Packing containers 1, 1' and 1'' are connected to one another, and lid 11 is connected to topmost container 1'', by means of respective connecting elements 13, 13' and 13'' disposed on the oppositely located shorter sidewalls 4.

Figure 3:
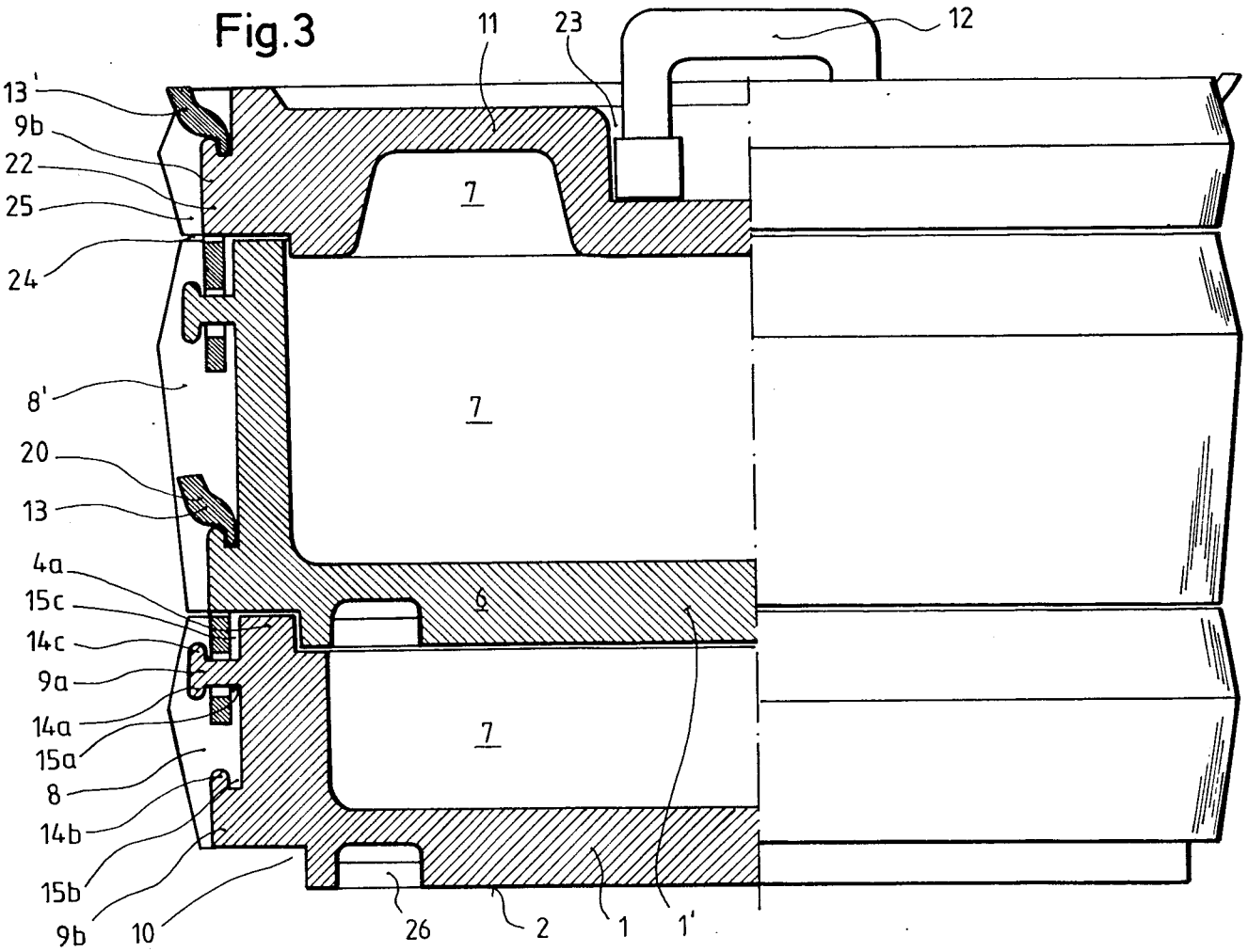
FIG. 3 shows a sectional view of a packing and storage unit.

These connections are shown in detail in FIG. 3, this figure showing two stacked packing containers 1 and 1' of different height, and a cover lid 11. Disposed in recesses 8 are locking means 9 in the form each of two elongate, rectangular projections 9*a* and 9*b*, the horizontal bordering edges of which are formed with engagement lugs 14 extending over their full length, a respective engagement groove 15 being formed between each engagement lug 14 and the bottom of recess 8. The projections 9*a* and 9*b* are integrally formed with the remainder of the respective packing container 1. Eack recess 8 thus contains a first engagement lug 14*a* with the associated engagement groove 15*a*, a second engagement lug 14*b* with the associated engagement groove 15*b*, and a third engagement lug 14*c* with the associated engagement groove 15*c*. The first engagement lug 14*a* is foremd on upper projection 9*a* and faces towards bottom 2. Second engagement lug 14*b* is formed on lower projection 9*b* and faces towards free edge 4*a* of sidewall 4. Third engagement lug 14*c* is formed on upper projection 9*a* between first engagement lug 14*a* and free upper edge 4*a* and faces towards free upper edge 4*a*.

Upper projection 9*a* projects from the bottom of recess 8 by a slightly greater distance than lower projection 9*b*. This difference is preferably selected such that the inner surface of engagement lug 14*a* defining engagement groove 15*a* is in alignment with the outer surface of lower projection 9*b*, i.e. that the height of upper projection 9*a* above the bottom of recess 8 is greater than that of lower projection 9*b* by the thickness of engagement lug 14*a*. This permits the substantially plate-shaped connecting element 13 to be disposed at a vertical position.

Figure 4:
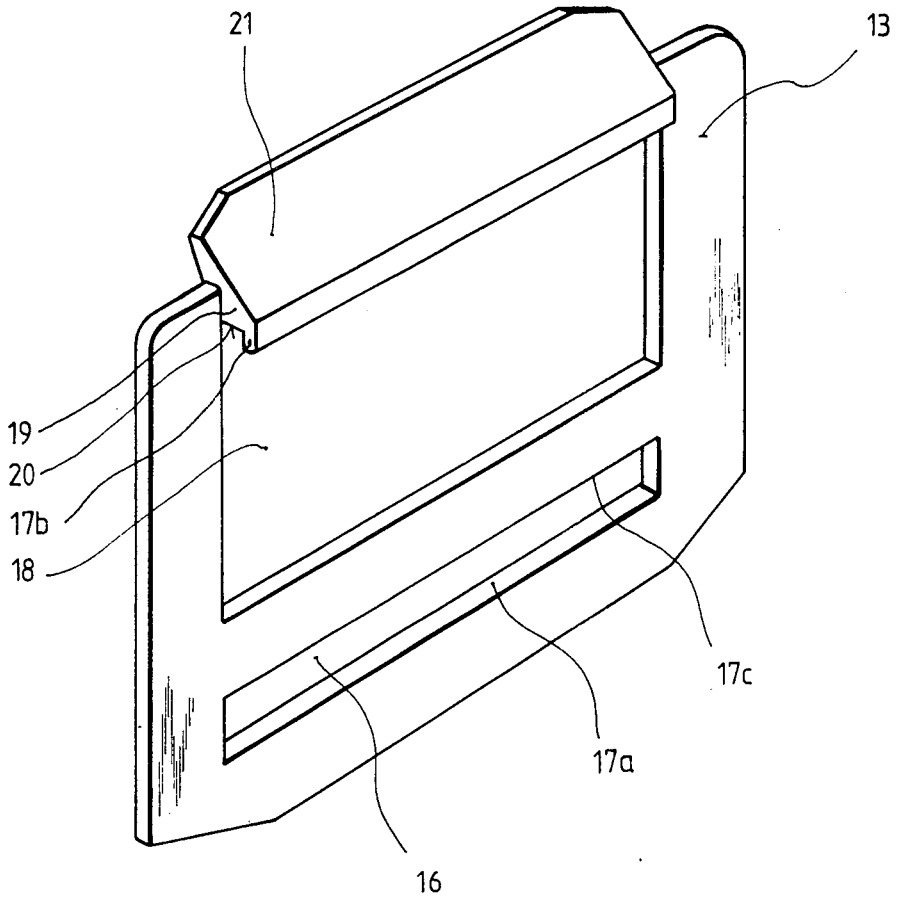
FIG. 4 shows a connecting element employed in the invention.

Connecting element 13 is shown in detail in FIG. 4. It is preferably formed of a plastics material in the form of a plate-shaped member the dimensions of which correspond to those of recess 8. Connecting element 13 is formed with a first lower opening 16 of a length corresponding to that of upper projection 9*a*, while its width is slightly smaller than that of upper projection 9*a*, i.e. slightly greater than or as great as the vertical distance between first and third engagement grooves 15*a* and 15*c*, respectively. The lower horizontal edge of opening 16 is formed as a first engagement lug 17*a* for engagement with the first engagement groove 15*a* of container 1. The portion below first engagement lug 17*a* may be formed with a somewhat increased wall thickness so as to strengthen engagement lug 17*a* which acts as one of the supporting surfaces on lifting the stacked containers. The second horizontal edge defining opening 16 is formed as a third engagement lug 17*c* for engagement with third engagement groove 15*c* of container 1. Above first opening 16 there is provided a second opening 18 of a size permitting a hand to pass therethrough. The dimensions of second opening 18 are selected in correspondence to those of second projection 9*b* of container 1. The upper margin of upper opening 18 is defined by a web portion 19 extending in the horizontal direction of connecting element 13 and formed with a second engagement lug 17*b*. The surface 20 of web portion 19 facing towards upper opening 18 is in alignment with the upper end surface defining opening 18 so as to form a second supporting surface on lifting the stacked containers. The surface of web portion 19 facing away from opening 18 is formed as a gripping surface mainly serving for releasing the engagement of second engagement lug 17*b* with second engagement groove 15*b* of container 1. To this purpose, gripping surface 21 preferably projects slightly beyond the outer surface of packing container 1.

Shown in FIG. 3 is the manner in which connecting element 13 holds two stacked containers 1 and 1' together. To accomplish this connection, lower opening 16 of connecting element 13 is first snap-engaged with upper projection 9*a* of the lower container, so that first and third engagement lugs 17*a* and 17*c*, respectively, of connecting element 13 are received in first and third engagement grooves, respectively, of container 1. In this state, connecting element 13 may be gripped through upper opening 18 for carrying lower packing container 1.

Engagement lugs 17*a* and 17*c* of connecting element 13 are preferably received in engagement grooves 15*a* and 15*c*, respectively, with a certain amount of play, i.e. the width of engagement grooves 15*a*, 15*c* is preferably slightly greater than the thickness of connecting element 13 at the location of engagement lugs 17*a* and 17*c*, so that connecting element may be pivoted outwards without appreciable stress. For the purpose of stacking, a second packing container 1', which may also be already provided with connecting elements 13, is placed onto lower container 1 in such a manner that free upper edges 3*a*, 4*a* of lower container 1 are received in recess 10' of upper container 1'. The connecting elements 13 of lower container 1 are subsequently pressed against the sidewalls 4' of upper container 1' with sufficient force to engage second engagement lug 17*b* with second engagement groove 15*b* of lower projection 9*b'* of upper packing container 1', so that supporting surface 20 comes to rest on engagement lug 14*b'*. In this manner it is possible to stack any number of packing containers of the type described on top of one another and to interconnect them by means of connecting elements 13, with the possible addition of lid 11 at the top of the stack.

Cover lid 11 is also formed with sidewalls 22 corresponding to sidewalls 4 of the packing containers. The interior of lid 11 is provided with a filler insert of the type described with reference to packing container 1 formed with cavities 7. Carrying handle 12 is preferably recessed in a depression 23 or hingedly mounted in a similar depression, so that it does not project above the top of the lid. At its side facing towards the packing container 1, lid 11 is formed with a circumferentially extending recess 24 corresponding to recess 10 of container 1. The two opposing sidewalls 22 of lid 11 are formed with a recess 25 extending over the full height of the sidewalls as in the case of containers 1. Disposed in recess 25 is the lower projection **9*b* of locking means 9, with the second engagement lug 15*b* and the second engagement groove 15*b*, permitting connecting element 13 of the topmost packing container 1** to be lockingly engaged with the cover lid.

Irrespective of the height of the containers to be stacked and of that of the cover lid, the distances between first engagement lug **14*a*first engagement groove 15*a* and free upper edge 4*a*, the distances between second engagement lug 14*b*/second engagement groove 15*b* and the bottom surface of the container, or the bottom of the respective recess 10 or 24, the distances between the respective engagement lugs and the bottom of recess 8 and the width of projections 9*a* and 9*b* are always equal, so that connecting elements 13** of one and the same size are required for connecting the packing containers to one another and to the cover lid.

Bottom 2 for packing container 1 is formed with a centrally located suspension eyelet 26 or with two spaced eyelets adjacent a longitudinal edge. Suspension eyelets 26 may preferably be formed as an undercut recess for receiving a wall hook for suspending the packing container from a wall in an upright position.

Figure 5:
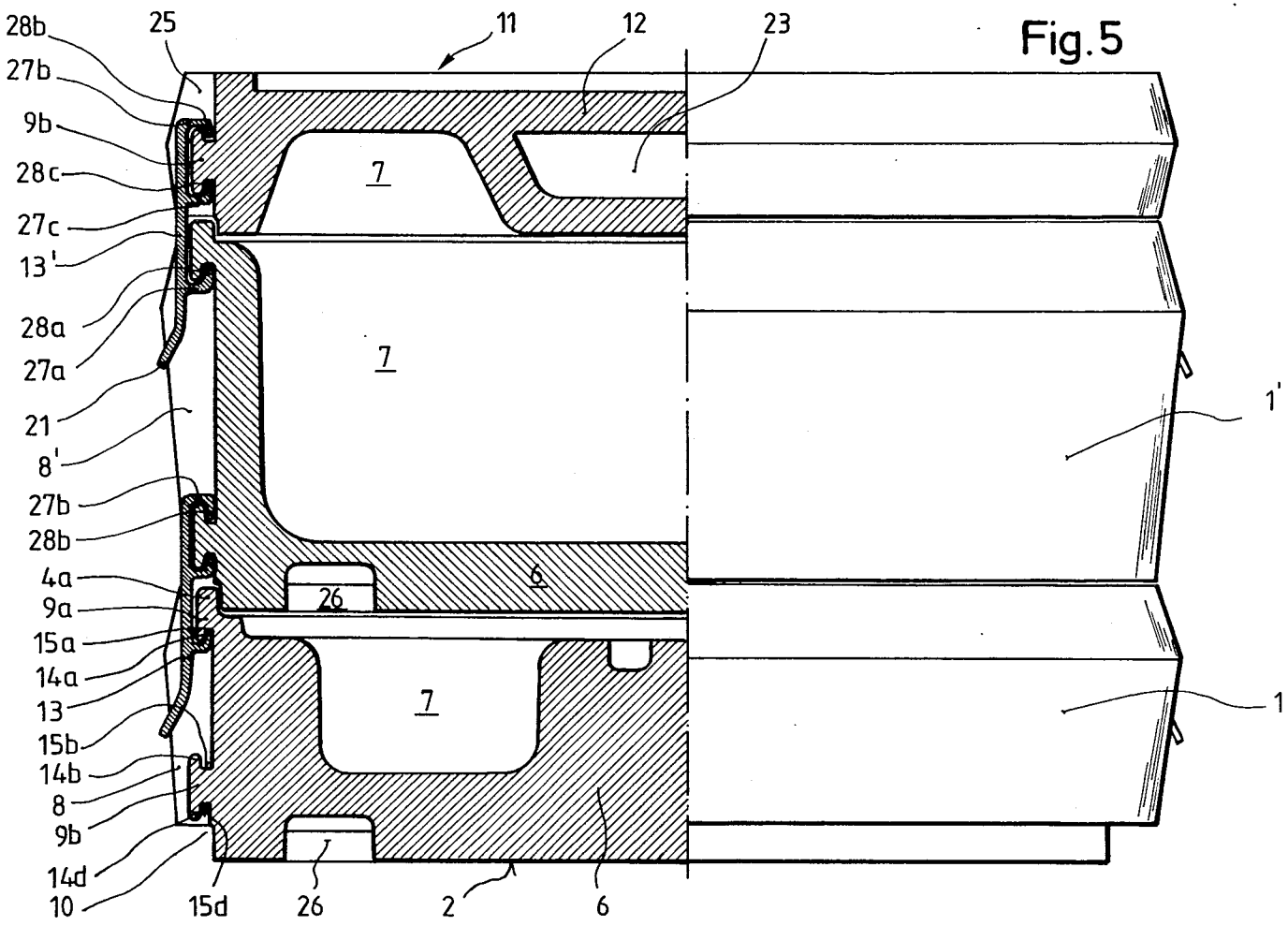
FIG. 5 shows a sectional view of a further embodiment of a packing and storage unit including a cover lid.

FIG. 5 shows a further embodiment of a connection arrangement according to the invention. Sidewalls 4 are again formed with a respective recess 8 containing locking means 9 in the shape of upper and lower projections **9*a* and 9*b*, respectively. The upper end surface of upper projection 9*a* preferably extends flush with free upper edge 4*a* of sidewall 4. The lower surface of upper projection 9*a* facing towards bottom 2 is formed by horizontally extending first engagement lug 14*a* and first engagement groove 15*a*. In a similar manner, the upper surface of lower projection 9*b* facing towards free upper edge 4*a* is formed by horizontally extending second engagement lug 14*b* and second engagement groove 15*b*, while its under surface facing towards bottom 2 is formed by horizontally extending third engagement lug 14*c* and third engagement groove 15*c*. Connecting element 13 is formed as a strip-shaped connection clamp provided at its side facing towards the containers with leg portions 27 carrying engagement lugs 28 for cooperation with the engagement grooves in a similar manner as described above. In this embodiment the strip-shaped connection clamps are in face-to-face engagement with projections 9*a* and 9*b***, requiring the latter to be of the same height.

In the embodiment shown in FIG. 5, the connection clamps are formed with downwards projecting grip portions 21 which have to be bent outwards for releasing the connection. This arrangement may also be reversed, however. In this case, the positioning of projections **9*a* and 9*b* would also have to be reversed, i.e. projection 9*b* with its second and third engagement groove would have to be located adjacent free upper edge 4*a*, while projection 9*a* would have to be located adjacent bottom 2 with first engagement lug 14*a*** facing upwards. The connection clamp would then have to be positioned with its grip portion projecting upwards.

In this embodiment the cover lid 11 is likewise so designed that it can readily be placed on top of containers 1 and secured thereto by means of connecting elements 13. In the embodiment shown, cover lid 11 is provided with a recessed carrying handle 12.

For sale the individual packing containers 1, 1' etc. with the tools or the like contained therein are separately on display, so that their contents can be inspected by the customer through the transparent cover 5. For shipping a suitable number of packing containers 1 possibly containing different tools and accessories therefor may be combined to form a packing and storage unit. To this purpose the packing containers are stacked and connected to one another by means of connecting elements 13. The topmost container of the stack may be provided only with the connecting elements 13 having grip openings formed therein, or with cover lid 11. If the original cover 5 does not consist of a stretchable sheet material, it has to be removed prior to stacking for enabling upper free edges **3*a* and 4*a* to be received in recesses 10 or 24**, respectively. The customer thus has at his disposal a compact packing and storage unit which he can readily carry about and in which the tools and accessories are stored in an orderly fashion and protected against damage and loss. Further packing containers may later be added to this unit as required.

The invention is not restricted to the embodiments described and shown in the drawings. In a connection arrangement employing engagement lugs as described, it may be fully sufficient to provide only the first and second engagement lugs on the components to be interconnected. Likewise, the locking means may be formed on the outer wall surface of the components, in which case they are preferably not in the form of projections, but in the form of recesses.

As an alternative, the connection may be accomplished by means of locking means and cooperating connecting elements in the form of a hinged connection. In this case a portion of the packing container adjacent the upper edge thereof is formed with a projection acting as an engagement and pivot point for snap engagement with one end of a preferably strip-shaped connecting element. The named projection is preferably of a shape permitting the connecting element to be freely rotated around the projection. The other end of the connecting element is formed with engagement means coooperating with locking means provided on the container in such a manner that the connection between stacked packing containers and a cover lid may be established by pivotal displacement of the connnecting element.

The circumferentially extending recess of the bottom may also be formed as a groove, the positioning and width of which correspond to those of the free upper edges of the sidewalls. The filler insert may be formed separately and subsequently inserted, and possibly secured, in the individual components, i.e. packing containers and cover lids. Use of the containers described is not either restricted to the storage of tools and accessories therefor. The containers may thus be used for packing and storing articles belonging to any combination system.

What is claimed as the invention is:

1. A tray-shaped packing container unit, particularly for tools, comprising at least two containers being arranged one above the other, each of said containers having four sidewalls terminating in free upper edges, and a bottom; said sidewalls and said bottom consisting of a shape-retaining material, the downwards facing outer surface of said bottom being formed with a circumferentially extending recess adjacent said sidewalls, the width of said recess corresponding at least to the width of said free upper edges of said sidewalls so as to permit the said edges to be received in the recess of an upper adjacent stacked container, the outer surfaces of at least two opposite sidewalls being formed with locking means engageable by connecting elements, said locking means and said connecting elements being provided with snap engagement elements comprising engagement lugs, each of said at least two opposite sidewalls being provided with at least one first engagement lug disposed adjacent the free edge of said sidewall and facing in a direction towards said bottom, and at least one second engagement lug disposed adjacent said bottom and facing in a direction towards said free edge, and each of said connecting elements being formed as a rectangular plate-shaped connection clamp having a pair of elongated openings in which said lugs are engagable, said snap engagement elements are provided on one side thereof and have projecting leg portions which support said engagement lugs, said first engagement lug of one of said at least two containers being engaged with said second engagement lug of the other of said at least two containers, for connecting said one container to said other packing container arranged one above the other.

2. A tray-shaped packing container unit, particularly for tools, comprising at least two containers being arranged one above the other, each of said containers having four sidewalls terminating in free upper edges, and a bottom; said sidewalls and said bottom consisting of a shape-retaining material, the downwards facing outer surface of said bottom being formed with a circumferentially extending recess adjacent said sidewalls, the width of said recess corresponding at least to the width of the free upper edges of said sidewalls, so as to permit the said edges to be received in the recess of an upper adjacent stacked container, the outer surfaces of at least two opposite sidewalls being formed with locking means engageable by connecting elements, said locking means and said connecting elements being provided with snap engagement elements comprising engagement lugs, each of said at least two opposite sidewalls being provided with at least one first engagement lug disposed adjacent the free edge of said sidewall and facing in a direction towards said bottom, and at least one second engagement lug disposed adjacent said bottom and facing in a direction towards said free edge, and each of said connecting elements being formed as a strip-shaped connection clamp and provided on one side thereof with projecting leg portions carrying said engagement lugs, said first engagement lug of one of at least two containers being engaged with said second engagement lug of the other of said at least two containers, for connecting said one container to said other packing container arranged one above the other.

3. The unit set forth in claim 1 further characterized in that said containers have an interior cavity, shaped to conform to the shape of the tools.

4. The unit set forth in claim 2 further characterized in that said containers have an interior cavity, shaped to conform to the shape of the tools.

5. A packing container according to claim 1, characterized in that above said first engagement lug (14*a*) there is provided a third engagement lug (14*c*) facing in a direction towards said free edge (4*a*) of said sidewall (4).

6. A packing container according to claim 2, characterized in that below said second engagement lug (14*b*) there is provided a third engagement lug (14*d*) facing in a direction towards said bottom (2).

7. A packing container according to claim 1, characterized in that said locking means (9) are disposed in a recess (8) extending along the center of said sidewall (4) over the full height thereof.

8. A packing container according to claim 1, characterized in that said engagement lugs (14) are formed along horizontal border edges of raised portions (9*a*, 9*b*) formed integrally with said sidewall (4).

9. A packing container according to claim 1, characterized in that said connecting element (13) for connecting packing containers (1, 1') placed on top of each other to one another has a first opening (16) including a first engagement lug (17*a*) cooperating with said first engagement lug (14*a*) of said locking means (9*a*), and a second opening (18) including a second engagement lug (17*b*) cooperating with said second engagement lug (14*b*) of said locking means (9*b*).

10. A packing container according to claim 9, characterized in that said second opening (18) is formed as a carrying handle.

11. A packing container according to claim 2, characterized in that said connecting element (13) is provided with a grip portion (21) for establishing and releasing the connection.

12. A packing container according to claim 1, characterized in that a filler insert (6) shaped to conform to the shape of the tools is integrally connected to said bottom (2) and/or said sidewalls (3, 4, 22).

13. A packing container according to claim 2, characterized in that said bottom (2) is provided with a suspension eyelet (26).

* * * * *